US008432266B2

(12) United States Patent
Varieur

(10) Patent No.: US 8,432,266 B2
(45) Date of Patent: Apr. 30, 2013

(54) PULL STATION

(75) Inventor: Steven T. Varieur, Winchendon, MA (US)

(73) Assignee: SimplexGrinnell LP, Westminster, MA (US)

( * ) Notice: Subject to any disclaimer, the term of this patent is extended or adjusted under 35 U.S.C. 154(b) by 176 days.

(21) Appl. No.: 13/074,994

(22) Filed: Mar. 29, 2011

(65) Prior Publication Data

US 2012/0249311 A1 Oct. 4, 2012

(51) Int. Cl.
*G08B 25/00* (2006.01)

(52) U.S. Cl.
USPC ..... 340/287; 200/331

(58) Field of Classification Search ..... 340/287; 200/331, 543
See application file for complete search history.

(56) References Cited

U.S. PATENT DOCUMENTS 4,551,707 A 11/1985 Simpson
5,590,759 A * 1/1997 Hawkins et al. ..... 200/331
D428,351 S 7/2000 Hohlfelder
6,380,846 B1 4/2002 Hohlfelder
6,632,108 B1 10/2003 Hohlfelder
D561,057 S 2/2008 Jones
D566,599 S 4/2008 Jones
D566,600 S 4/2008 Jones
D566,601 S 4/2008 Jones
7,408,477 B2 8/2008 Finkle et al.
2011/0120024 A1 * 5/2011 Shilts ..... 49/506

* cited by examiner

*Primary Examiner* — Shirley Lu
(74) *Attorney, Agent, or Firm* — Kacvinsky Daisak pllc

(57) ABSTRACT

A pull station for an alarm includes a housing having an actuator mounted for movement with respect thereto. The actuator has a standby (i.e., normal) position and an alarm position. The actuator has a contoured actuation surface configured such that downward pressure on the actuation surface moves the actuator from the standby position to the alarm position. The actuator may be rotatably or slidably coupled to the housing. The actuation surface may extend beyond the front face of the housing when in the standby position. In some embodiments, the actuation surface is cup-shaped. In other embodiments, the actuation surface is v-shaped, with first and second angled portions forming oblique angles with respect to a lateral axis of the housing. Thus arranged, the actuator can be operated by a disabled who may not have complete hand or finger dexterity. Other embodiments are described and claimed.

9 Claims, 8 Drawing Sheets

PULL STATION

FIELD OF THE DISCLOSURE

The disclosure relates generally to alarms operable upon the opening or closing of a door, lever or the like, and more particularly, to a pull station for an alarm system that is operable without the use of hands.

BACKGROUND OF THE DISCLOSURE

Fire alarm pull stations are well known and, as often required by laws and municipal ordinances, are secured to the walls of corridors and hallways in many locations throughout buildings such as schools, hospitals, and the like. In known fire alarm pull stations, a lever is provided which can be manually pivoted or pulled to set off a local or centralized fire alarm. The alarm pull stations mount on a wall and are typically color coded to be easily recognizable in an emergency.

Current pull stations are designed for hand operation, requiring the user to insert one or more fingers laterally into a recess in the pull station to grip an interior surface of the handle or lever to pull it outward, away from the housing. This movement trips a mechanical or electrical switch which activates the fire alarm.

The problem with such pull station actuators is that they may not be readily operated by the disabled. Specifically, many disabled individuals may not possess the hand or finger dexterity required for operating current pull stations. For persons suffering from quadriplegia, for example, operating current pull stations may be impossible.

Thus, there is a need for an improved pull station that can be easily and reliably operated by disabled individuals. Preferably, such a pull station will be operable without the use of hands.

SUMMARY OF THE DISCLOSURE

A pull station is disclosed having an actuator that includes a contoured actuation surface that can be operated using a simple downward directed motion. In one embodiment, the actuation surface of the actuator is cup-shaped to enable easy actuation without the use of hands. Thus, the user could activate the pull station by placing their elbow, chin, stub, etc. onto the cup-shaped actuator and applying a downward force. Such force may cause the actuator to swing down and place the pull station into an alarm mode.

A pull station for an alarm system is disclosed. The pull station comprises a housing, and an actuator coupled to the housing. The actuator has a standby position and an alarm position. The actuator further includes a actuation surface formed by first and second arms oriented at an angle with respect to each other. The actuator is configurable from the standby position to the alarm position by applying a downward force on the actuation surface.

An actuator for an alarm system pull station is also disclosed. The actuator comprises an actuator having a user engaging portion and a pull station engaging portion. The pull station engaging portion can be configured to operatively engage an alarm system pull station. The user engaging portion may comprise first and second angled portions extending in opposite directions from a central portion. Each of the first and second angled portions form an oblique angle with respect to a longitudinal axis of the actuator. The first and second angled portions and the central portion form an actuation surface. The actuator is configurable from a standby position to an alarm position by applying a downward force on the actuation surface.

A pull station for an alarm system is disclosed, comprising a housing and an actuator. The housing has a front face and a rear face, where the rear face is configured for engaging a building structure. A first end of the actuator is coupled to the housing. The actuator having a standby position and an alarm position. A second end of the actuator includes a contoured actuation surface formed by first and second angled arms such that the actuator is movable from the standby position to the alarm position by applying a downward force on the contoured actuation surface.

BRIEF DESCRIPTION OF THE DRAWINGS

By way of example, specific embodiments of the disclosed system and method will now be described, with reference to the accompanying drawings.

DETAILED DESCRIPTION

An improved pull station is disclosed for enabling operation by a disabled user. Specifically, the pull station includes an actuator that can be operated by a user having very limited ability to move their hands, or who cannot use their hands at all. In one exemplary embodiment, the actuator includes a contoured surface that receives a user's chin, elbow or other appendage to operate the pull station.

Figure 1:
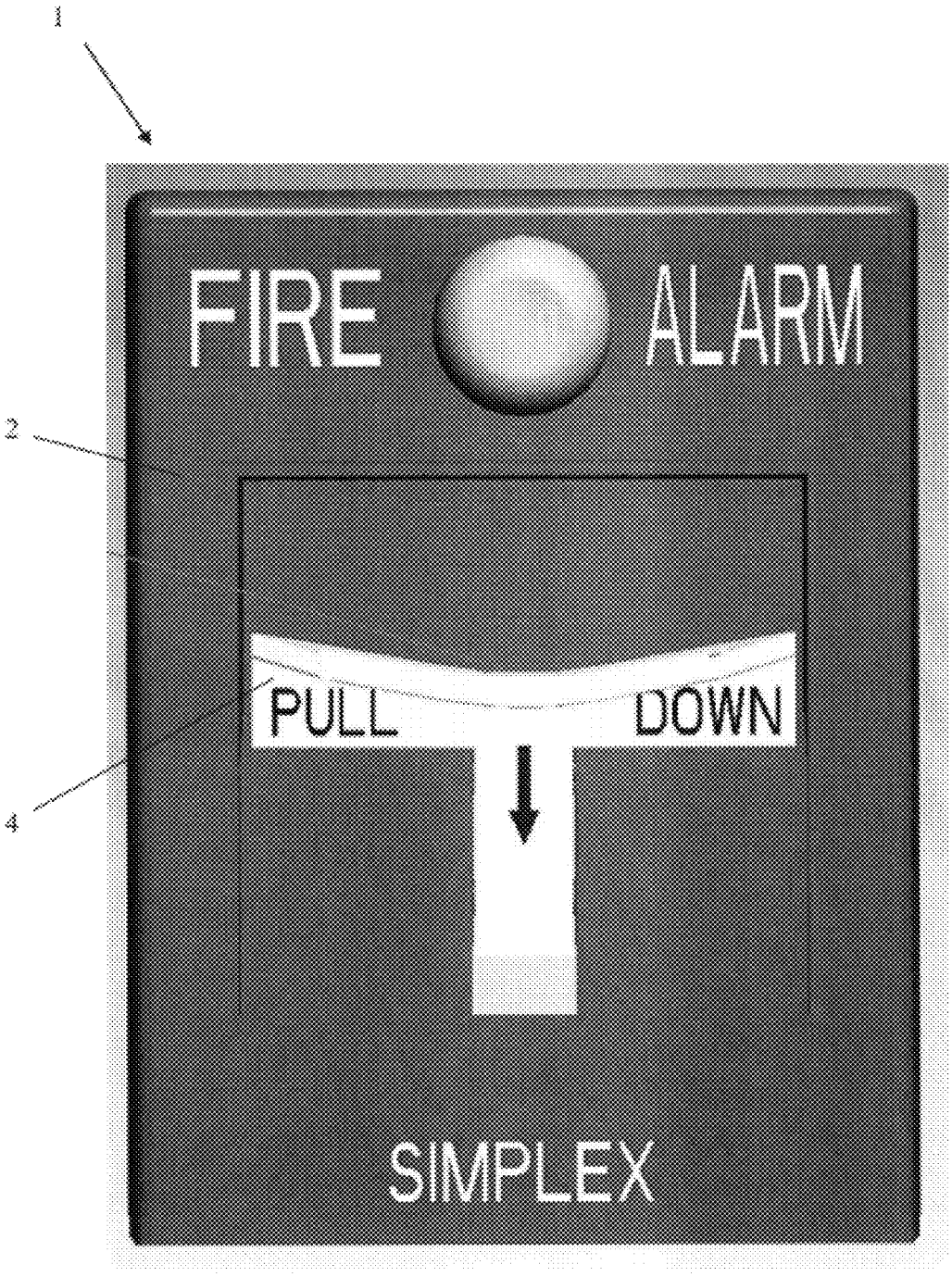
FIG. 1 is a front view of the disclosed pull station.
Figure 2:
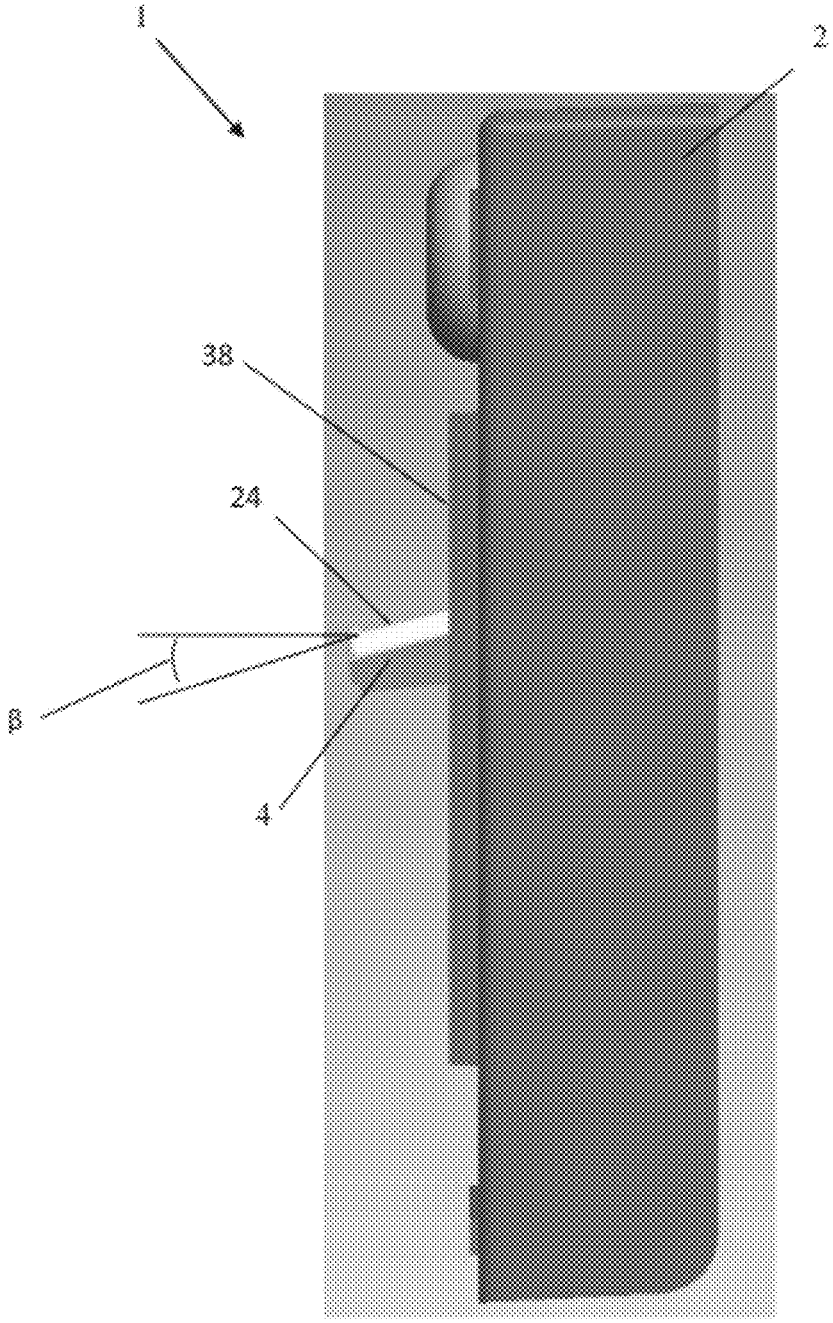
FIG. 2 is a side view of the pull station of FIG. 1.

Referring to FIGS. 1 and 2, a pull station 1 generally includes a housing 2 and an actuator 4. The actuator 4 is movable with respect to the housing 2 to enable a user to configure the pull station 1 from a standby state to an alarm state. In one embodiment, the actuator 4 is slidable with respect to the housing 2. In another embodiment, the actuator 4 is rotatable with respect to the housing 2. Although the illustrated embodiment relates to a fire alarm, it will be appreciated that a pull station incorporating the disclosed structure can be used with a variety of different alarm systems.

Figure 3:
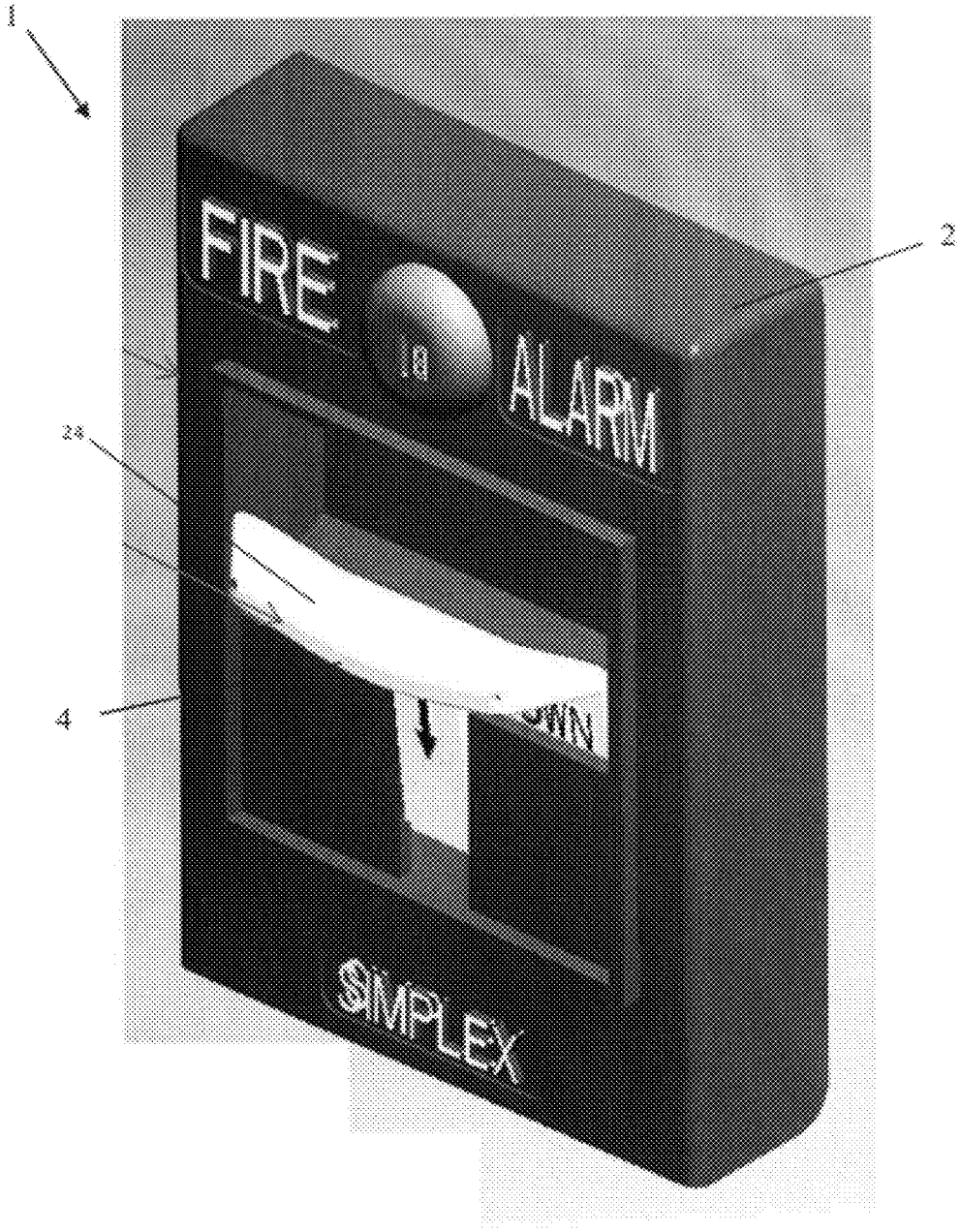
FIG. 3 is an isometric view of the pull station of FIG. 1 in which the actuator is in the standby position.
Figure 4:
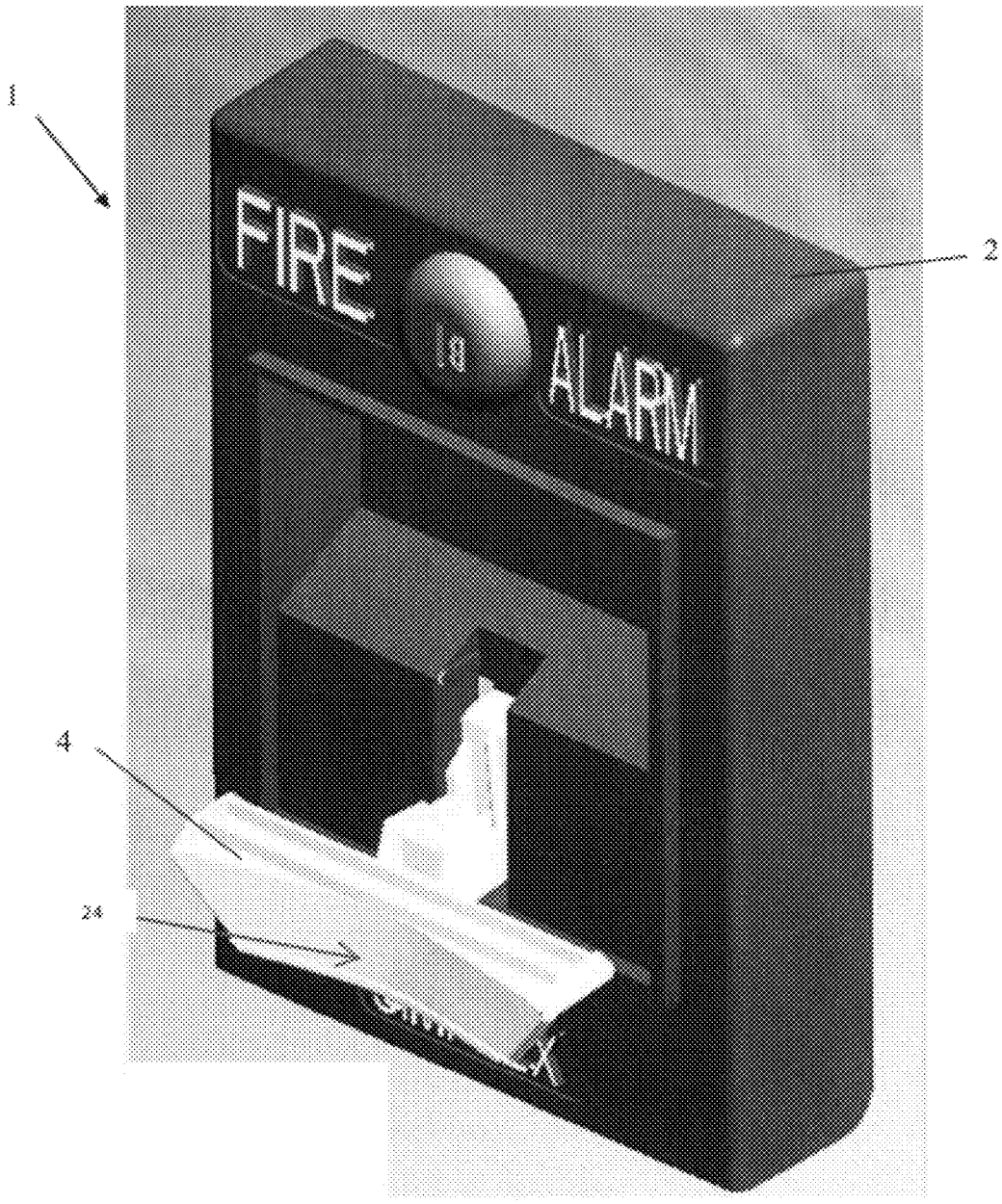
FIG. 4 is an isometric view of the pull station of FIG. 1 in which the actuator is in the alarm position.
Figure 5:
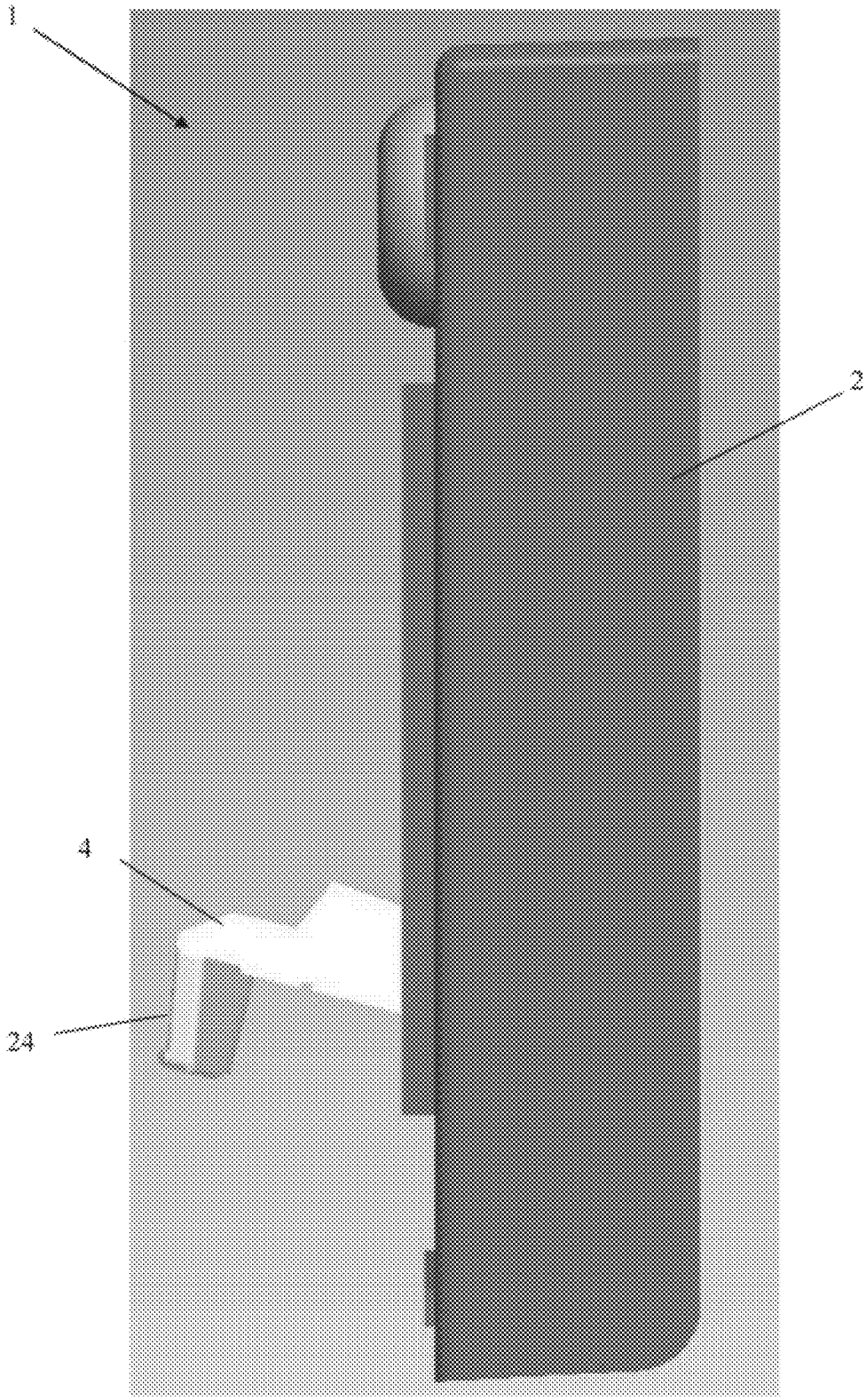
FIG. 5 is a side view of the pull station FIG. 1 in which the actuator is in the alarm position.

FIGS. 1-3 show the pull station 1 in the standby position. This will be recognized as the normal non-alarm state of the pull station 1. FIGS. 4 and 5, by contrast, show the pull station 1 in the alarm, or activated, position. In this position, the actuator 4 is displaced downward (rotated in the illustrated embodiment) with respect to the housing 2. As will be appreciated, rotating the actuator 4 actuates a switch within the housing 2 which signals an alarm condition. In traditional pull stations 1, the activated, or alarm, position is achieved by a user grasping the actuator with one or more fingers and applying a downward force to either rotate or slide the actuator with respect to the housing.

Figure 6:
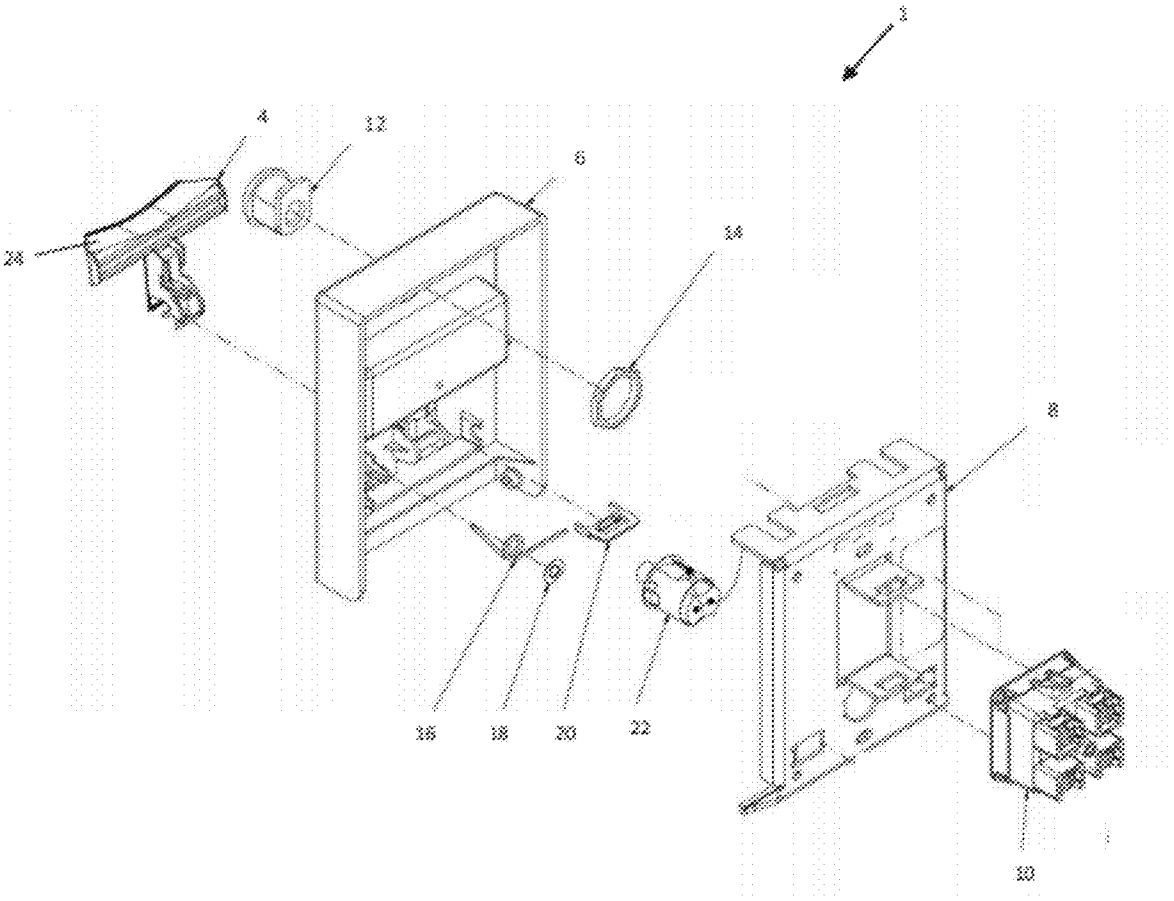
FIG. 6 is an exploded isometric view of the pull station of FIG. 1.

FIG. 6 shows the arrangement of elements that make up the disclosed pull station 1, including actuator 4, housing cover assembly 6, housing backplate assembly 8, addressable pull station module 10, cover lock 12, hex nut 14, actuator spring 16, spring retainer 18, cover clip 20 and alarm switch 22. The housing backplate assembly 8 can be attached to a wall or other structure, while the addressable pull station assembly can be connected to appropriate wiring of an associated alarm system. It will be appreciated that although the exemplary pull station 1 of FIG. 6 is described as being addressable, the disclosed actuator 4 can be used with any of a variety of addressable and non-addressable pull stations.

With the FIG. 6 arrangement, when the actuator 4 is rotated with respect to the housing cover assembly 6, a portion of the actuator 4 engages the alarm switch 22, which sends a signal to the associated alarm system via the addressable pull station assembly 10.

As previously noted, traditional pull stations may be difficult or impossible for disabled individuals to operate because they typically require the user to insert one or more fingers into a recess in the housing and to grasp the actuator within the recess. For users that have less than full facility with their hands or fingers, it may not be possible to access or operate the actuator in this manner.

To accommodate such individuals, the disclosed pull station 1 includes an actuator 4 having a contoured surface that enables a disabled user to operate the pull station 1 without having to pinch or grasp the actuator. That is, a disabled user can operate the disclosed pull station by simply applying downward pressure on an actuation surface 24 of the actuator 4. The "contour" of the actuation surface 24 is easily engageable by a user's chin, elbow or other appendage. In some embodiments, at least a portion of the actuation surface 24 extends out from the front surface of the housing to further facilitate user engagement and operation.

Referring now to FIGS. 7A-7E, the actuator 4 will be described in greater detail. As can be seen, the actuator 4 may have a longitudinal axis A-A, and a user engaging portion 26 including contoured actuation surface 24. A pull station engaging portion 28 may be positioned at an end opposite the user engaging portion 26. The pull station engaging portion 28 may be configured to operatively engage the pull station 1 in a known manner such that movement of the actuator with respect to the pull station 1 causes an alarm condition to be transmitted via the pull station 1 to an associated alarm system. In the illustrated embodiment, the pull station engaging portion 28 is rotatably coupled to the pull station housing 2. It will be appreciated, however, that rotational actuation is not critical, and thus in other embodiments the pull station engaging portion 28 is slidably coupled to the pull station housing such that a simple downward sliding motion can result in activation of an alarm condition.

Figure 7A:
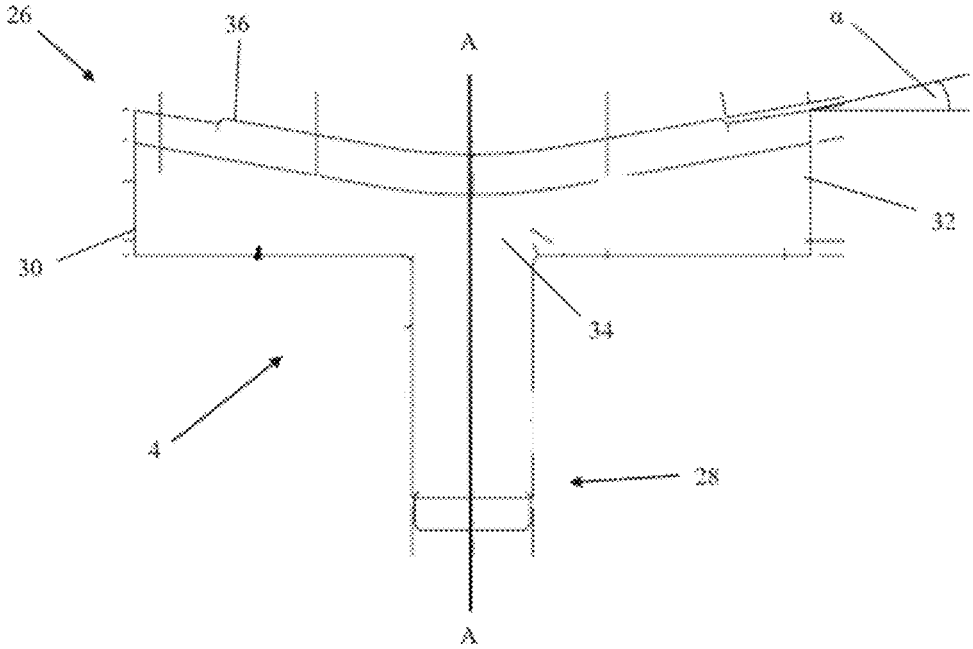
FIGS. 7A-7D are front, top plan, back and side views of the actuator portion of the pull station of FIG. 1.
Figure 7B:
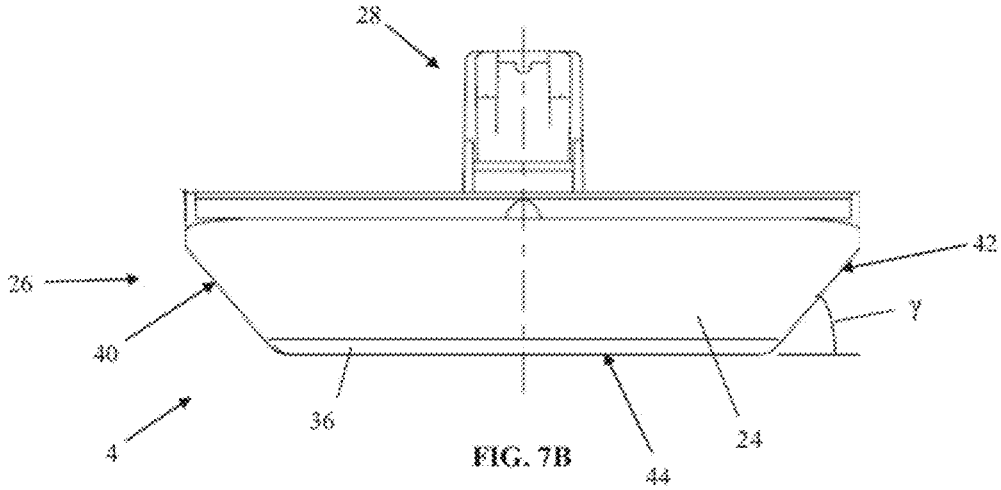
Figures 7C, 7D:
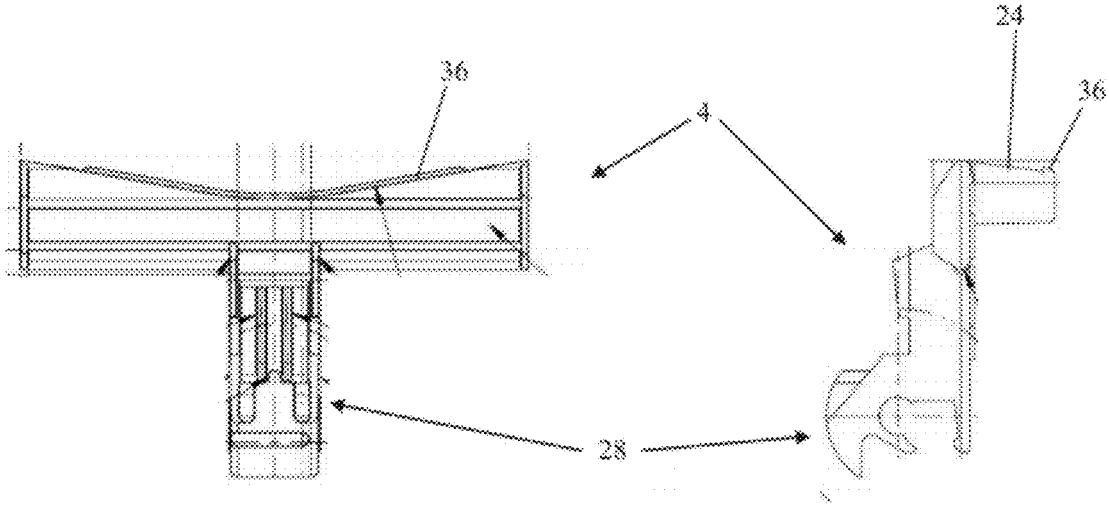

FIG. 7A shows the user engaging portion 26 including first and second arms 30, 32 which extend in opposite directions from a central portion 34. The central portion may connect the user engaging portion 26 to the pull station engaging portion 28. The first and second arms 30, 32 may each form an oblique angle "α" with respect to the longitudinal axis A-A of the actuator 4. Thus, the first and second arms 30, 32 are angled with respect to each other. This angle "α" may preferably be about 5 degrees to about 15 degrees, and more preferably about 8 degrees to about 11 degrees. [In one exemplary, non-limiting embodiment, the angle "α" is about 10 degrees.

In this embodiment, the first and second arms 30, 32 provide the contoured actuation surface 24 of the actuator 4 with a cup-shaped appearance. As will be appreciated, this cup-shape facilitates engagement of the actuator using portions of the body other than hands and fingers. For example, a user could easily engage the actuator 4 using an elbow, chin, foot, or the like. Alternatively, a user could engage the disclosed actuator 4 using an object such as a cane.

Although the illustrated embodiment shows a user engaging portion 26 including a pair of discretely-angled arms 30, 32 and a flat central portion 34, it will be appreciated that other arrangements are contemplated to provide a desired ease of engagement. For example, the user engaging portion 26 could be U-shaped, V-shaped, and the like. Moreover, where the user engaging portion 26 is "cup-shaped," such a cup-shaped arrangement may include, by non-limiting example, a cylindrical, conical, or concave shape. Any of a variety of other conformal shapes are also contemplated.

As can be seen in FIG. 2, the user engaging portion 26 of the actuator 4 extends outward from the front surface 38 of the housing 2 when the actuator is in the standby position. This protruding geometry enables easy manipulation of the user engaging portion 26 so that the actuator may be operated without requiring the user to fit an appendage into a recess in the housing 2.

In some embodiments, the actuation surface 24 of the user engaging portion 26 may be angled downward to facilitate operation of the actuator 4. In one embodiment, the actuation surface 24 of the actuator forms an angle "β" (FIG. 2) with respect to a line oriented perpendicular to the front surface 38 of the housing 2. This angle "β" may preferably be about 5 degrees to about 15 degrees, and more preferably about 7 degrees to about 9 degrees. In one non-limiting exemplary embodiment, this angle "β" may be about 8 degrees.

To further enhance user-engagement of the actuator 4, a raised lip 36 may be provided at a forward edge of the actuation surface 24. This raised lip 36 may facilitate a secure grip with a chin, elbow or the like on the actuation surface 24 while the actuator is being operated. This may be particularly useful where the actuator 4 rotates during use, since the actuation surface 24 of the user engaging portion 26 will shift during rotation from an upwardly-facing direction to a laterally-facing direction.

Other enhanced gripping features may also be provided on, or adjacent to, the actuation surface. For example, multiple raised lips may be disposed over a portion of the actuation surface 24. In addition, or alternatively, the actuation surface 24 may be provided with any of a variety of surface texturing features.

As noted, the user engaging portion 26 can extend outward from the front surface 38 of the housing 2. As such, it can be desirable to reduce the chance for accidental actuation of the pull station due to a person or object brushing against the actuator 4. Thus, the distal surfaces 40, 42 of each of the first and second arms 30, 32 may be faired, or angled, with respect to the front edge 44 of the actuation surface 24. This angle "γ" may preferably be about 40 degrees to about 60 degrees, and more preferably about 49 degrees to about 51 degrees. In one non-limiting exemplary embodiment, γ may be about 50-degrees. As will be appreciated, this angling of the distal surfaces 40, 42 eliminates hard corners on the outer edges of the user engaging portion 26 of the actuator 4.

Although the illustrated embodiment shows the distal surfaces as being straight angled, other configurations could also be provided to achieve a similar effect. For example, the distal surfaces 40, 42 could be rounded (convex or concave). Further, only a portion of the distal surfaces could be angled, or rounded.

Although the illustrated embodiments show the actuator extending beyond the face of the housing 2, it will be appreciated that an actuator 4 having the disclosed cup-shaped actuation surface 24 could also be provided flush with the housing front surface 38. Such an actuator arrangement provides enhanced gripping without the use of hands as compared to current devices. Where a flush actuator is provided, it may also be desirable to provide increased gap area between the actuation surface 24 of the actuator 4 and the housing 2 to enable a user's elbow or other appendage to be inserted between the actuation surface 24 and the housing 2 to enable actuation of the device.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A pull station for an alarm system, comprising:

a housing having a front face; and an actuator coupled to the housing, the actuator having an actuation surface formed by first and second arms having first and second angled portions extending in opposite directions from a central stem, the first and second angled portions forming oblique angles with respect to a lateral axis of the housing, the oblique angles being in the range of 5 degrees to 15 degrees, wherein the actuator is rotatably moveable relative to the housing between a standby position, wherein the actuation surface is adjacent the housing and faces upwardly, and an alarm position, wherein the actuation surface is rotated outward, away from the housing; and wherein the actuation surface extends outward from the front face when the actuator is in the standby position.

2. The pull station of claim 1, wherein the actuation surface is concave.

3. The pull station of claim 1, wherein the first and second arms have distal edges, each of the distal edges forming an acute angle with respect to a front edge of the actuation surface.

4. The pull station of claim 1, further comprising a lip disposed along at least a portion of a front edge of the actuation surface.

5. An actuator for an alarm system pull station, comprising:

an actuator having a user engaging portion and a pull station engaging portion, the pull station engaging portion configured to operatively engage an alarm system pull station, the user engaging portion comprising first and second angled portions extending in opposite directions from a central stem, each of the first and second angled portions forming oblique angles with respect to a longitudinal axis of the actuator, the oblique angles being in the range of 5 degrees to 15 degrees, the first and second angled portions and the central stem forming an actuation surface, wherein the actuator is rotatably moveable relative to the housing between a standby position, wherein the actuation surface is adjacent the housing and faces upwardly, and an alarm position, wherein the actuation surface is rotated outward, away from the housing; and wherein the actuation surface extends outward from the front face when the actuator is in the standby position.

6. The actuator of claim 5, wherein the actuation surface is concave.

7. The actuator of claim 5, wherein the actuation surface includes surface texturing.

8. The actuator of claim 5, wherein the first and second angled portions have distal edges, each of the distal edges forming an acute angle with respect to a front edge of the actuation surface.

9. The actuator of claim 5, further comprising a lip disposed along at least a portion of a front edge of the actuation surface.

* * * * *